US012698547B2

(12) United States Patent
Li et al.

(10) Patent No.: US 12,698,547 B2
(45) **Date of Patent: *Aug. 4, 2026**

(54) METHODS AND SYSTEMS FOR DIE CASTING

(71) Applicant: MetaLi LLC, Manhattan Beach, CA (US)

(72) Inventors: Madelyn Li, Manhattan Beach, CA (US); Jasmine Li, Manhattan Beach, CA (US)

(73) Assignee: MetaLi LLC, Manhattan Beach, CA (US)

( * ) Notice: Subject to any disclaimer, the term of this patent is extended or adjusted under 35 U.S.C. 154(b) by 303 days.

This patent is subject to a terminal disclaimer.

(21) Appl. No.: 18/364,334

(22) Filed: Aug. 2, 2023

(65) Prior Publication Data

US 2023/0381857 A1 Nov. 30, 2023

Related U.S. Application Data

(63) Continuation of application No. 18/169,746, filed on Feb. 15, 2023.

(Continued)

(51) Int. Cl.

| | |
|---|---|
| ***C22C 21/04*** | (2006.01) |
| ***B22D 17/20*** | (2006.01) |
| ***B22D 21/00*** | (2006.01) |
| ***C22C 21/02*** | (2006.01) |
| ***C22C 23/00*** | (2006.01) |

(Continued)

(52) U.S. Cl.

CPC ..... *C22C 21/04* (2013.01); *B22D 17/20* (2013.01); *B22D 21/007* (2013.01); *C22C 21/02* (2013.01); *C22C 23/00* (2013.01); *C22F 1/043* (2013.01); *C25D 11/14* (2013.01)

(58) Field of Classification Search

CPC ..... C22C 21/04

See application file for complete search history.

(56) References Cited

U.S. PATENT DOCUMENTS 4,060,462 A 11/1977 Kampert
9,023,128 B2 5/2015 Li et al.

(Continued)

FOREIGN PATENT DOCUMENTS

CN 118984882 A 11/2024
CN 120076882 A 5/2025

(Continued)

OTHER PUBLICATIONS

Jude Mary Runge, Anodizing ASM Handbook, vol. 2A, Aluminum Science and Technology, Kevin Anderson, John Weritz, and J. Gilbert Kaufman, editors, 2018, pp. 590-605.*

(Continued)

*Primary Examiner* — Christopher S Kessler
(74) *Attorney, Agent, or Firm* — KPPB LLP

(57) ABSTRACT

Methods and systems for high pressure die casting with metal alloys of low silicon content are described. Metal alloys can be modified with nanoparticles to achieve high fluidity and hot cracking resistance to be compatible with high pressure die casting. The die cast metal parts have high strength, high ductility, and high thermal and electrical conductivity. The die cast metal parts can be anodized with different colors.

12 Claims, 3 Drawing Sheets

Related U.S. Application Data

(60) Provisional application No. 63/268,049, filed on Feb. 15, 2022.

(51) Int. Cl.
*C22F 1/043* (2006.01)
*C25D 11/14* (2006.01)

(56) References Cited

U.S. PATENT DOCUMENTS

| | | | |
|---|---|---|---|
| 9,322,084 | B2 | 4/2016 | Li et al. |
| 11,040,395 | B2 | 6/2021 | Li et al. |
| 2009/0038720 | A1 | 2/2009 | Lumley et al. |
| 2009/0133849 | A1 | 5/2009 | Bakke et al. |
| 2016/0348220 | A1 | 12/2016 | Ji et al. |
| 2019/0111478 | A1 | 4/2019 | Li et al. |
| 2019/0161835 | A1 | 5/2019 | Martin et al. |
| 2019/0210163 | A1 | 7/2019 | Berube et al. |
| 2021/0078068 | A1* | 3/2021 | Woestmann ..... B22C 9/103 |
| 2021/0388469 | A1 | 12/2021 | Li et al. |
| 2023/0383384 | A1 | 11/2023 | Li et al. |
| 2024/0131578 | A1 | 4/2024 | Li et al. |
| 2024/0226998 | A9 | 7/2024 | Li et al. |

FOREIGN PATENT DOCUMENTS

| | | | |
|---|---|---|---|
| EP | 2503017 | B1 | 12/2016 |
| EP | 4479204 | A2 | 12/2024 |
| EP | 4605155 | A2 | 8/2025 |
| IN | 202417069035 | A | 1/2025 |
| JP | 2025507451 | A | 3/2025 |
| RU | 2570264 | C2 | 12/2015 |
| WO | 2007071542 | A1 | 6/2007 |
| WO | 2020018477 | A1 | 1/2020 |
| WO | 2020150830 | A1 | 7/2020 |
| WO | 2020210706 | A1 | 10/2020 |
| WO | 2021150604 | A1 | 7/2021 |
| WO | 2022023738 | A1 | 2/2022 |
| WO | 2023159080 | A2 | 8/2023 |
| WO | 2023159080 | A3 | 10/2023 |
| WO | 2024086636 | A2 | 4/2024 |
| WO | 2024086636 | A3 | 6/2024 |

OTHER PUBLICATIONS

International Search Report and Written Opinion for International Application No. PCT/US2023/062677, Search completed Apr. 30, 2023, Mailed Aug. 15, 2023, 14 pgs.

Guo et al., "Achieving high combination of strength and ductility of Al matrix composite via in-situ formed Ti—Al3Ti core-shell particle", Materials Characterization, 2020, vol. 170, article No. 110666, 9 pgs, retrieved from the Internet: < DOI: 10.1016/j.matchar.2020.110666 >; see entire document, especially, p. 1-2.

Jeyasimman et al., "An investigation of the synthesis, consolidation and mechanical behaviour of Al 6061 nanocomposites reinforced by TiC via mechanical alloying", Materials and Design, 2014, vol. 57, pp. 394-404.

International Preliminary Report on Patentability for International Application PCT/US2023/077182, Report issued Mar. 1, 2025, Mailed May 1, 2025, 7 Pgs.

International Preliminary Report on Patentability for International Application PCT/US2023/062677, Report issued Aug. 20, 2024, Mailed Aug. 29, 2024, 8 Pgs.

International Search Report and Written Opinion for International Application No. PCT/US2023/077182, Search completed Mar. 22, 2024, Mailed Apil 29, 2024, 16 Pgs.

Liu et al., "Molten Salt Assisted Solidification Nanoprocessing of Al—TiC Nanocomposites", Materials Letters, 2016, vol. 185, 392-395.

Nawrocki et al., "Influence of Process Parameters on Cooling Conditions in Nickel Base Superalloy Investment Casting", Key Engineering Materials, 2015, 641, 124-131.

Yu et al., "Physical simulation of investment casting for GTD-222 Ni-based superalloy processed by controlled cooling rates", Int J Adv Manuf Technol, 2019, 105, 3531-3542.

Extended European Search Report for European Application No. 23757060.1, Search completed Dec. 2, 2025, Mailed Dec. 18, 2025, 15 pgs.

Bangaru et al., "Development of Metal Matrix Nanocomposites of AA6061—SiCp Using Ultrasonic Cavitations in Squeeze Casting Process", vol. 2b: Advanced Manufacturing, Nov. 13, 2015, pp. 1-9, XP093342537, DOI: 10.1115/IMECE2015-53151ISBN: 978-0-7918-5736-6Retrieved from the Internet:URL:https://asmedigitalcollection.asme.org/IMECE/proceedings/IMECE2015/57366/Houston,%20Texas,%20USA/256270>.

Ding et al., "Interfacial Reactions and Mechanical Properties of 6061 Al Matrix Composites Reinforced with Alumina-Coated Al18B4033 Whiskers", Materials Letters, Elsevier, Amsterdam, Nl, Aug. 1, 2000 , vol. 45, No. 1, , pp. 6-11, XP004256516, Issn: 0167-577x, Doi: 10.1016/S0167-577x(00)00063-X.

Kannan et al., "Comparative Study on the Mechanical and Microstructural Characterisation of AA 7075 Nano and Hybrid Nanocomposites Produced by Stir and Squeeze Casting", Journal Of Advanced Research, Elsevier, Amsterdam, Nl, Mar. 8, 2017, vol. 8, No. 4, pp. 309-319, XP085115863,, ISSN: 2090-1232, DOI: 10.1016/J.JARE.2017.02.005.

Moses et al., "Investigation on the Tensile Strength and Microhardness of AA6061/TiC Composites by Stir Casting", Fundamentals of Petroleum and Petrochemical Engineering, May 14, 2016, vol. 70, No. 4, pp. 1035-1046, XP036203449, Doi: 10.1007/S12666-016-0891-Y [Retrieved on May 14, 2016].

* cited by examiner

METHODS AND SYSTEMS FOR DIE CASTING

CROSS-REFERENCE TO RELATED APPLICATIONS

The current application is a continuation of U.S. patent application Ser. No. 18/169,746 entitled "Methods and Systems for High Pressure Die Casting" filed Feb. 15, 2023, which claims the benefit of and priority to U.S. Provisional Patent Application No. 63/268,049 entitled "Methods and Systems for High Pressure Die Casting" filed Feb. 15, 2022. The disclosures of which are hereby incorporated by reference in their entirety for all purposes.

FIELD OF THE INVENTION

The present invention generally relates to methods and systems for high pressure die casting with metal alloys of low silicon content; and more particularly to methods and systems for high pressure die casting with low silicon content metal alloys modified with nanoparticles.

BACKGROUND OF THE INVENTION

Die cast metal alloys have applications in various industries. Die cast metal alloys generally require both high strength and ductility. Metal alloys should also have good castability and heat cracking resistance to be suitable for high pressure die casting processes. Traditionally, silicon has been added to metal alloys, such as aluminum alloys, to improve the fluidity of metal alloys to be compatible with high pressure die casting. However, high silicon content may deteriorate ductility, thermal conductivity, electrical conductivity, and anodizing capability of metal alloys. Metal alloys with uncompromised ductility and conductivities, that are also suitable for high pressure die casting processes may be desired.

BRIEF SUMMARY OF THE INVENTION

Methods and systems for high pressure die casting with metal alloys of low silicon content modified with nanoparticles are illustrated.

An embodiment of the invention includes a metal alloy for high pressure die casting, comprising a metal alloy selected from the group consisting of an aluminum alloy, a magnesium alloy, a copper alloy, and a zinc alloy; and at least one type of nanoparticle dispersed in the metal alloy; wherein the metal alloy comprises less than 4.0 wt. % silicon; and wherein the metal alloy is compatible with a high pressure die casting process.

In another embodiment, the metal alloy is selected from the group consisting of A201, AA2024, A206, AA2618, AA5083, AA6013, AA6061, AA6063, AA6069, AA7034, AA7050, AA7075, and AA7068.

In an additional embodiment, the at least one type of nanoparticle is selected from the group consisting of a metal oxide, a non-metal oxide, a metal carbide, a non-metal carbide, a metal silicide, a metal boride, a metal nitride, and any combinations thereof.

In a further embodiment, the at least one type of nanoparticle has a structure of a core-shell particle.

In another embodiment, the nanoparticle comprises less than 30 vol. % of the metal alloy.

In a further yet embodiment, the nanoparticle comprises 0.1 vol. % to 2 vol. % of the metal alloy.

In yet another embodiment, the metal alloy comprises AA6061 and the nanoparticle comprises TiC, and the TiC nanoparticle comprises 1.0 vol. % of the metal alloy.

In a further embodiment again, the high pressure die casting process uses a pressure between 30 MPa and 100 MPa.

In an additional embodiment, the high pressure die casting process uses a pressure greater than 100 MPa.

In another embodiment again, the high pressure die casting process comprises a cooling step with a cooling rate between 100° C./s and 300° C./s.

A further embodiment includes a method for high pressure die casting comprising:

providing a metal alloy modified with at least one type of nanoparticle, wherein the metal alloy comprises a silicon weight concentration of less than 4.0%;

melting the metal alloy and filling a die with the molten metal alloy under a pressure, wherein the pressure is compatible with the high pressure die casting process; and cooling the die to solidify the molten metal alloy.

In a further yet embodiment, the method further comprising anodizing the die cast metal alloy with at least one color.

In another embodiment, the metal alloy is selected from the group consisting of an aluminum alloy, a magnesium alloy, a copper alloy, and a zinc alloy.

In an additional embodiment, the metal alloy is selected from the group consisting of A201, AA2024, A206, AA2618, AA5083, AA6013, AA6061, AA6063, AA6069, AA7034, AA7050, AA7075, and AA7068.

In another yet embodiment, the at least one type of nanoparticle is selected from the group consisting of a metal oxide, a non-metal oxide, a metal carbide, a non-metal carbide, a metal silicide, a metal boride, a metal nitride, and any combinations thereof.

In a further yet embodiment, the at least one type of nanoparticle has a structure of a core-shell particle.

In an additional embodiment, the at least one type of nanoparticle comprises less than 30 vol. % of the metal alloy.

In another embodiment again, the nanoparticle comprises 0.1 vol. % to 2 vol. % of the metal alloy.

In a further embodiment, the metal alloy comprises AA6061 and the nanoparticle comprises TiC, and the TiC nanoparticle comprises 1.0 vol. % of the metal alloy.

In another embodiment again, the die cast metal alloy as formed has a elongation equal to or less than 30% and an ultimate tensile strength greater than 500 MPa.

In an additional embodiment again, the die cast metal alloy has a thickness of at least 0.2 mm.

In a further yet embodiment, the pressure is between 30 MPa and 100 MPa.

In yet another embodiment, the pressure is greater than 100 MPa.

In another embodiment, the die is cooled with a cooling rate between 100° C./s and 300° C./s.

In a further embodiment again, the method further comprising a post process of the die cast metal alloy.

In an additional embodiment, the post process is selected from the group consisting of: a T5 treatment, a natural aging treatment, and a T6 treatment.

Another embodiment includes a high pressure die cast metal part comprising a metal alloy; and at least one type of nanoparticle dispersed in the metal alloy; wherein the metal alloy comprises less than 4.0 wt. % silicon; wherein the metal part is produced via a high pressure die casting process; and wherein the die cast metal part has a thickness of at least 0.2 mm.

In a further embodiment, the metal alloy is selected from the group consisting of an aluminum alloy, a magnesium alloy, a copper alloy, and a zinc alloy.

In an additional embodiment, the metal alloy is selected from the group consisting of A201, AA2024, A206, AA2618, AA5083, AA6013, AA6061, AA6063, AA6069, AA7034, AA7050, AA7075, and AA7068.

In another embodiment again, the at least one type of nanoparticle is selected from the group consisting of a metal oxide, a non-metal oxide, a metal carbide, a non-metal carbide, a metal silicide, a metal boride, a metal nitride, and any combinations thereof.

In a further embodiment again, the at least one type of nanoparticle has a structure of a core-shell particle.

In a further yet embodiment, the nanoparticle comprises less than 30 vol. % of the metal alloy.

In yet another embodiment, the nanoparticle comprises 0.1 vol. % to 2 vol. % of the metal alloy.

In a further embodiment, the metal alloy comprises AA6061 and the nanoparticle comprises TiC, and the TiC nanoparticle comprises 1.0 vol. % of the metal alloy.

In another embodiment again, the high pressure die casting process uses a pressure between 30 MPa and 100 MPa.

In yet another embodiment, the high pressure die casting process uses a pressure greater than 100 MPa.

In a further embodiment again, the high pressure die casting process comprises a cooling step with a cooling rate between 100° C./s and 300° C./s.

In an additional embodiment, the metal part is anodized with at least one color.

Another embodiment includes a method for improving castibility of a metal alloy comprising incorporating at least one type of nanoparticle into a metal alloy; wherein the metal alloy comprises less than 4.0 wt. % silicon; wherein the nanoparticle comprises less than 30 vol. % of the metal alloy; and wherein the metal alloy is compatible with a high pressure die casting process.

In a yet further embodiment, the metal alloy selected from the group consisting of an aluminum alloy, a magnesium alloy, a copper alloy, and a zinc alloy.

In an additional embodiment, the metal alloy is selected from the group consisting of A201, AA2024, A206, AA2618, AA5083, AA6013, AA6061, AA6063, AA6069, AA7034, AA7050, AA7075, and AA7068.

In another yet embodiment, the at least one type of nanoparticle is selected from the group consisting of a metal oxide, a non-metal oxide, a metal carbide, a non-metal carbide, a metal silicide, a metal boride, a metal nitride, and any combinations thereof.

In a further embodiment, the at least one type of nanoparticle has a structure of a core-shell particle.

In a yet further embodiment, the nanoparticle comprises 0.1 vol. % to 2 vol. % of the metal alloy.

In another embodiment again, the metal alloy comprises AA6061 and the nanoparticle comprises TiC, and the TiC nanoparticle comprises 1.0 vol. % of the metal alloy.

In yet another embodiment, the high pressure die casting process uses a pressure between 30 MPa and 100 MPa.

In an additional embodiment again, the high pressure die casting process uses a pressure greater than 100 MPa.

In another yet embodiment again, the high pressure die casting process comprises a cooling step with a cooling rate between 100° C./s and 300° C./s.

Additional embodiments and features are set forth in part in the description that follows, and in part will become apparent to those skilled in the art upon examination of the specification or may be learned by the practice of the disclosure. A further understanding of the nature and advantages of the present disclosure may be realized by reference to the remaining portions of the specification and the drawings, which forms a part of this disclosure.

DETAILED DESCRIPTION OF THE INVENTION

Figure 1:
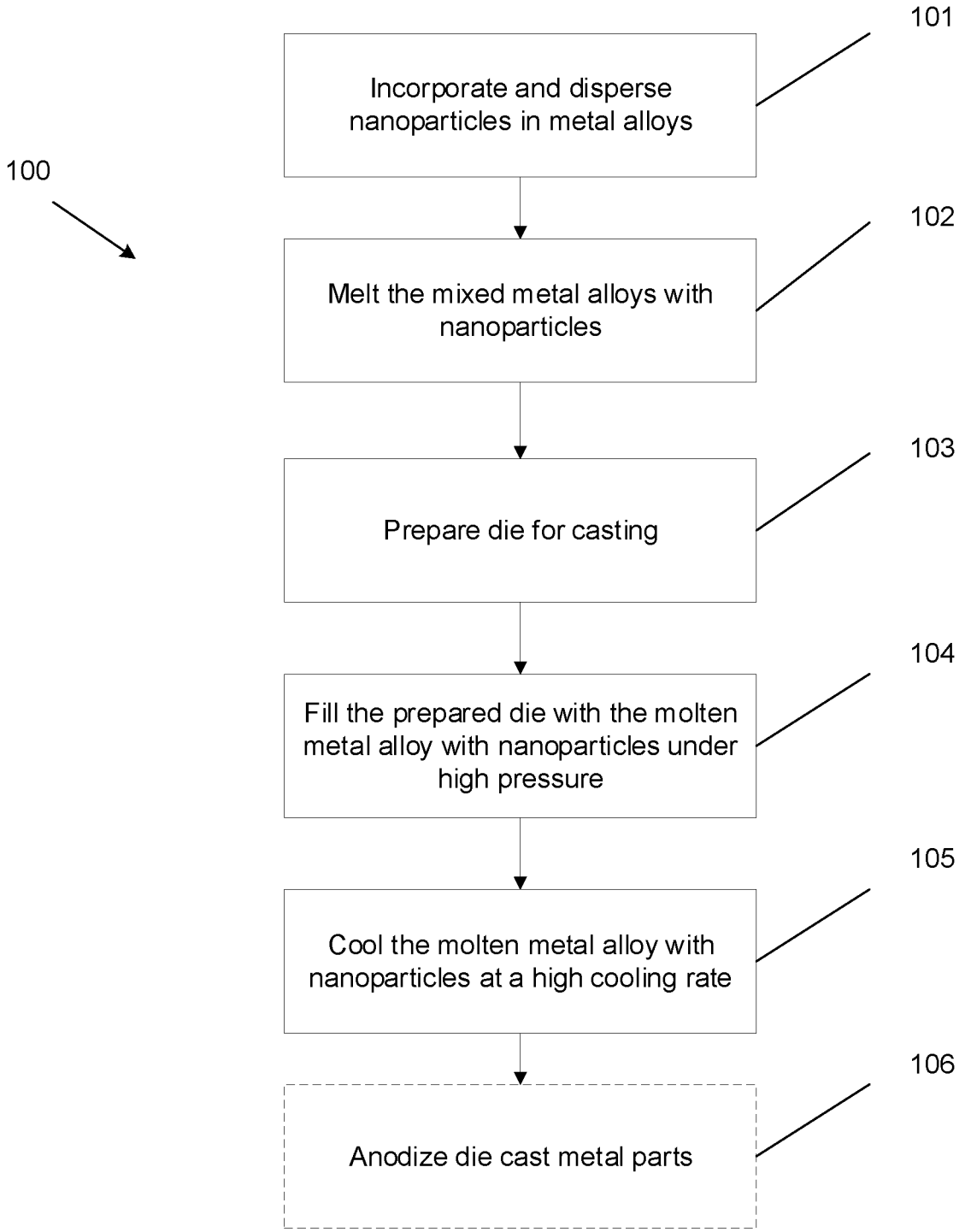
FIG. 1 illustrates a high pressure die casting process in accordance with an embodiment of the invention.

Turning now to the drawings, methods and systems for high pressure die casting using low silicon content metal alloys are described. Many embodiments provide low silicon content metal alloys including (but not limited to) aluminum alloys modified with nanoparticles for high pressure die casting processes. Die casting processes in accordance with some embodiments produce high strength, high ductility, and high thermal conductivity metal parts. Certain embodiments provide die cast metal parts can be anodized to produce parts of desired colors. Several embodiments provide that the nanoparticles can enhance the fluidity of aluminum alloys under high pressure, and avoid issues including (but not limited to) die-sticking and hot cracking during die casting. The nanoparticle modified metal alloys in accordance with certain embodiments allow die cast high performance metal alloys that contain low or no silicon contents. High performance aluminum alloys with low silicon contents are traditionally impossible to die cast due to problems such as hot cracking. Die cast metal alloys with low silicon content in accordance with some embodiments can enable mass production of aluminum alloys with high strength, excellent ductility and thermal conductivity. Many embodiments provide that the aluminum alloys with low silicon contents would allow good anodizing capability to offer colorful parts. In a number of embodiments, the combination of strength and ductility may allow the die cast metal parts for structural components. In certain embodiments, the high thermal conductivity of the die cast aluminum parts, in addition to the good strength and ductility, may allow efficient thermal management in applications including (but not limited to) heat sinks and exchangers.

Normally, nanoparticles may increase the viscosity of molten metal alloys, which may not be ideal for high pressure die filling and rapid cooling processes during die casting. However, the nanoparticles in accordance with many embodiments enable die casting of high performance alloys including (but not limited to) high-performance wrought and cast aluminum alloys, with a silicon content from about 0 wt % to about 4.0 wt % for structural applications. Several embodiments provide that nanoparticles can simultaneously enhance the fluidity of alloys and eliminate hot cracking during rapid cooling. The enhanced fluidity of metal alloys in accordance with certain embodiments can be compatible with die filling processes under high pressure. In various embodiments, the pressure for the die casting process can range from about 30 MPa to about 100 MPa; or lower than about 30 MPa; or higher than about 100 MPa. As can readily be appreciated, any of a variety of pressure can be utilized as appropriate to the requirements of specific applications in accordance with various embodiments of the invention.

Many embodiments provide that metal alloys being resistant to hot cracking can stand cooling processes with a high cooling rate. In several embodiments, the cooling rate can be from about 100° C./s to about 300° C./s; or lower than about 100° C./s; or higher than about 300° C./s. As can readily be appreciated, any of a variety of cooling rate can be utilized as appropriate to the requirements of specific applications in accordance with various embodiments of the invention.

The improved fluidity and castability of metal alloys by nanoparticles in accordance with certain embodiments enable to die cast metal part with a thickness from about 0.2 mm to about 0.5 mm; or a thickness greater than about 0.5 mm.

In several embodiments, die cast metal alloys have ductility and/or elongation of less than or equal to about 20%; or less than or equal to about 30%. In some embodiments, die cast metal alloys can have strength of greater than or equal to about 500 MPa. The thermal conductivity of die cast metal alloys can be less than or equal to about 230 W/mw; or greater than about 230 W/mw; in accordance with a number of embodiments. The ductility, strength, and thermal conductivity are measured for as cast metal alloys without post processing.

In several embodiments, die cast metal parts can be anodized to add any desired color(s). Examples of anodized colors include (but are not limited to): red, blue, pink, gold, yellow, green, and any combinations thereof. As can readily be appreciated, any of a variety of color can be utilized as appropriate to the requirements of specific applications in accordance with various embodiments of the invention.

For the purpose of this invention, the term "die casting" can also be interpreted to "high pressure die casting", except where otherwise noted.

High pressure die casting processes in accordance with various embodiments of the invention are discussed further below.

High Pressure Die Casting

Die casting can be an economical mass production method for metal parts. During the die casting processes, molten metal can be injected into a mold under high pressure before solidification at a high cooling rate (ranging from about tens of degree Celsius per second to about hundreds of degree Celsius per second). The applied pressure can be hydraulic or pneumatic pressure. This pressure can be maintained until the casting solidifies. The molds, known as dies, can be made from high quality tool steel, can produce geometrically complex parts, and lend high degrees of accuracy and repeatability to the processes. The high pressure filling of the die in high pressure die casting may allow the molten alloy to be injected quickly and, enable automated processes with high productivity.

In comparison to gravity die casting (also known as permanent mold casting), the molten metal is poured into the mold from above purely under gravitational force. As gravity die casting relies on gravity to fill the mold, the process can be slower and therefore less suited for mass production runs.

High pressure die casting can have advantages including (but not limited to) high dimensional accuracy, smooth cast surfaces, reducing or eliminating secondary machining operations, rapid production rates, etc. However, one disadvantage for high pressure die casting is that the process is limited to metals with high fluidity. As the injection process is under high pressure (from about 30 MPa to about 100 MPa) and the molten alloy is solidified at a high cooling rate (from about tens to hundreds of degree Celsius per second), low fluidity molten alloys and/or high viscosity molten alloys may clog the mold cavity so as to affect the accuracy of the cast part. In addition to high fluidity, alloys suitable for high pressure die casting should have good resistance to cracking under high pressure and high cooling rate.

Anodizing is a process in which alloy parts are used as anode and stainless steel, chromium, or conductive electrolyte are used as the cathode in the proper electrolyte. Under certain voltage and current conditions, the anode is oxidized to obtain anodized film on the surface of workpiece. Sulfuric acid anodizing may be used in the anodizing and coloring process. Anodizing can provide colors and/or protective films for the die cast alloys.

Metal Alloys for High Pressure Die Casting

Various types of metal alloys including (but not limited to) zinc alloy, aluminum alloy, copper alloy, and tin alloy, can be used in high pressure die casting. Aluminum alloys have been widely used in consumer electronics, automotive, aerospace, ship building and other fields due to its plasticity, corrosion resistance and light weight. Die cast aluminum parts find wide applications in industries including computer devices, communication devices, consumer electronics, automobiles, buildings, windows, aerospace, and sports. Since high pressure die casting often operates at a high cooling rate at tens to hundreds of degree Celsius per second for metals, the fluidity and hot cracking resistance of the alloys can be crucial for the integrity of parts, especially for thin wall structures. Traditionally high performance aluminum alloys including (but not limited to) A201, AA2024, A206, AA2618, AA5083, AA6013, AA6061, AA6063, AA6069, AA7034, AA7050, AA7075, and AA7068 offer good strength, ductility, and fatigue life, as well as anodizing capability and thermal conductivity. Unfortunately, these alloys are not suited for die casting due to low fluidity and hot cracking issues.

Al—Si alloys are one of the most popular die cast aluminum alloys. Silicon may help alloy fluidity largely due to its high heat of crystallization. As silicon solidifies, a large amount of heat may be released to reheat liquid aluminum, enhancing the melt fluidity. For die cast alloys, a silicon content above 4.5 wt % (often ranging from about 8 wt % to about 13 wt %) and adequate alloying elements including (but not limited to) Fe and/or Mn are added to ensure high fluidity and hot cracking resistance. Thus, die casting aluminum alloy and die casting parts generally contain silicon content higher than about 4.5 wt %. Examples of Al—Si alloys suitable for die casting include (but are not limited to): AA360, A360, AA380, AA383, AA384, B390, AA413, A413, and C443.

However, the silicon phase in the Al—Si alloys would appear gray or black after anodizing, and the anodized alloy and/or parts may appear in a dark color, which can be undesirable in many applications with cosmetics requirements. With the increase of silicon content, the color of the anodized film changes from light gray to dark gray to black-gray. Therefore, cast aluminum alloy with high silicon content may not be suitable for anodizing. Moreover, the high content of silicon and other elements used to tackle fluidity and hot cracking in aluminum die casting alloys can deteriorate the ductility and thermal conductivity and/or electrical conductivity of the aluminum alloys after die casting.

There are some aluminum alloy systems with low silicon content. One example of aluminum alloy with low silicon content includes Al—Mg systems, such as AA 518, Al-8Mg. Another example of low silicon aluminum alloy includes Al—Mg—Si systems. Al—Mg—Si systems can include 2 wt %-5.5 wt % Mg, 1.5 wt %-3 wt % Si, trace of Mn, trace of Fe, with the balance being A1. Examples of Al—Mg—Si system alloys include (but are not limited to) Magsimal-59, C446, Aural-11, Calypso 53 and 54SM. However, these aluminum alloys with low silicon content can be difficult to die cast due to low fluidity and high cracking tendency. In addition, such alloys can be very sensitive to wall thickness, especially thin walls. Furthermore, the low silicon aluminum alloy may require toxic Be as an additive, and can be susceptible to hot tear and stress corrosion cracking. Moreover, their thermal conductivity may be low due to the alloy contents.

Table 1 below reproduced from North American Die Casting Association (NADCA) includes chemical compositions of various Al—Si alloys and an Al-8Mg alloy used in high pressure die casting. All single values are maximum composition percentages unless otherwise stated.

TABLE 1

Aluminum Die Casting Alloy Compositions.

| Aluminum Die Casting Alloys (A)(E) | | | | | | | | | | | |
|---|---|---|---|---|---|---|---|---|---|---|---|
| Commercial: | 360 | A360 | 380(B) | A380(B) | 383 | 384(B) | B390* | 13 | A13 | 43 | 218 |
| ANSI/AA | 360.0 | A360.0 | 380.0 | A380.0 | 383.0 | 384.0 | B390.0 | 413.0 | A413.0 | C443.0 | 518.0 |
| Nominal Comp: | Mg 0.5 Si 9.0 | Mg 0.5 Si 9.5 | Cu 3.5 Si 8.5 | Cu 3.5 Si 8.5 | Cu 2.5 Si 10.5 | Cu 3.8 Si 11.0 | Cu 4.5 Si 17.0 | Si 12.0 | Si 12.0 | Si 5.0 | Mg 8.0 |
| Detailed Composition | | | | | | | | | | | |
| Silicon Si | 9.0-10.0 | 9.0-10.0 | 7.5-9.5 | 7.5-9.5 | 9.5-11.5 | 10.5-12.0 | 16.0-18.0 | 11.0-13.0 | 11.0-13.0 | 4.5-6.0 | 0.35 |
| Iron Fe | 2.0 | 1.3 | 2.0 | 1.3 | 1.3 | 1.3 | 1.3 | 2.0 | 1.3 | 2.0 | 1.8 |
| Copper Cu | 0.6 | 0.6 | 3.0-4.0 | 3.0-4.0 | 2.0-3.0 | 3.0-4.5 | 4.0-5.0 | 1.0 | 1.0 | 0.6 | 0.25 |
| Magnesium Mg | 0.4-0.6 | 0.4-0.6 | 0.30(F) | 0.30(F) | 0.10 | 0.10 | 0.45-0.65 | 0.10 | 0.10 | 0.10 | 7.5-8.5 |
| Manganese Mn | 0.35 | 0.35 | 0.50 | 0.50 | 0.50 | 0.50 | 0.50 | 0.35 | 0.35 | 0.35 | 0.35 |
| Nickel Ni | 0.50 | 0.50 | 0.50 | 0.50 | 0.30 | 0.50 | 0.10 | 0.50 | 0.50 | 0.50 | 0.15 |
| Zinc Zn | 0.50 | 0.50 | 3.0 | 3.0 | 3.0 | 3.0 | 1.5 | 0.50 | 0.50 | 0.50 | 0.15 |
| Tin Sn | 0.15 | 0.15 | 0.35 | 0.35 | 0.15 | 0.35 | — | 0.15 | 0.15 | 0.15 | 0.15 |
| Titanium Ti | — | — | — | — | — | — | 0.10 | — | — | — | — |
| Others Each | — | — | — | — | — | — | 0.10 | — | — | — | — |
| Total Others (C) | 0.25 | 0.25 | 0.50 | 0.50 | 0.50 | 0.50 | 0.20 | 0.25 | 0.25 | 0.25 | 0.25 |
| Aluminum Al | Balance | Balance | Balance | Balance | Balance | Balance | Balance | Balance | Balance | Balance | Balance |

Table 2 from NADCA reproduced below includes mechanical properties of aluminum alloys used in high pressure die casting. Typical values based on "as-cast" characteristics for separately die cast specimens, not specimens cut from production die castings.

TABLE 2

Aluminum Die Casting Alloy Properties.

| | Aluminum Alloys | | | | | | | | | | |
|---|---|---|---|---|---|---|---|---|---|---|---|
| Designation | 360.0 | A360.0 | 380.0 | A380.0 | 383.0 | 384.0 | B390.0 | 413.0 | A413.0 | C443.0 | 518.0 |
| Mechanical Properties | | | | | | | | | | | |
| Ultimate Tensile Strength | | | | | | | | | | | |
| ksi (MPa) | 44 (300) | 46 (320) | 46 (320) | 47 (320) | 45 (310) | 48 (330) | 46 (320) | 43 (300) | 42 (290) | 33 (230) | 45 (310) |
| Tensile Yield Strength (A) | | | | | | | | | | | |
| ksi (MPa) | 25 (170) | 24 (170) | 23 (160) | 23 (160) | 22 (150) | 24 (170) | 36 (250) | 21 (140) | 19 (130) | 14 (100) | 29 (190) |
| Compressive Yield Strength (B) | | | | | | | | | | | |
| ksi (MPa) | — | — | — | — | — | — | — | — | — | — | — |
| Elongation | | | | | | | | | | | |
| % in 2 in. (51 mm) | 2.5 | 3.5 | 3.5 | 3.5 | 3.5 | 2.5 | <1 | 2.5 | 3.5 | 9.0 | 5.0 |
| Hardness | | | | | | | | | | | |
| BHN | 75(C) | 75(C) | 80(C) | 80(C) | 75(C) | 85(C) | 120(C) | 80(C) | 80(C) | 65(C) | 80(C) |
| Shear Strength | | | | | | | | | | | |
| ksi (MPa) | 28 (190) | 26 (180) | 28 (190) | 27 (190) | — | 29 (200) | — | 25 (170) | 25 (170) | 19 (130) | 29 (200) |
| Impact Strength | | | | | | | | | | | |
| Ft-lb (J) | — | — | 3 (4) | — | 3(F) (4) | — | — | — | — | — | 7 (9) |

TABLE 2-continued

| Aluminum Die Casting Alloy Properties. | | | | | | | | | | | |
|---|---|---|---|---|---|---|---|---|---|---|---|
| | Aluminum Alloys | | | | | | | | | | |
| Designation | 360.0 | A360.0 | 380.0 | A380.0 | 383.0 | 384.0 | B390.0 | 413.0 | A413.0 | C443.0 | 518.0 |
| Fatigue Strength | | | | | | | | | | | |
| ksi (MPa) | 20(D) (140) | 18(D) (120) | 20(D) (140) | 20(D) (140) | 21(D) (145) | 20(D) (140) | 20(D) (140) | 19(D) (130) | 19(D) (130) | 17(D) (120) | 20(D) (120) |
| Young's Modulus | | | | | | | | | | | |
| psi × $10^6$ (GPa) | 10.3 (71) | 10.3 (71) | 10.3 (71) | 10.3 (71) | 10.3 (71) | — | 11.8 (81.3) | 10.3 (71) | — | 10.3 (71) | — |
| Physical Properties | | | | | | | | | | | |
| Density | | | | | | | | | | | |
| lb/in$^3$ (g/cm$^3$) | 0.095 (2.63) | 0.095 (2.63) | 0.099 (2.74) | 0.098 (2.71) | 0.099 (2.74) | 0.102 (2.82) | 0.098 (2.73) | 0.096 (2.66) | 0.096 (2.66) | 0.097 (2.69) | 0.093 (2.57) |
| Melting Range | | | | | | | | | | | |
| ° F. (° C.) | 1035-1105 (557-596) | 1035-1105 (557-596) | 1000-1100 (540-595) | 1000-1100 (540-595) | 960-1080 (516-582) | 960-1080 (516-582) | 950-1200 (510-650) | 1065-1080 (574-582) | 1065-1080 (574-632) | 1065-1170 (574-632) | 995-1150 (535-621) |
| Specific Heat | | | | | | | | | | | |
| BTU/lb° F. (J/kg° C.) | 0.230 (963) | 0.230 (963) | 0.230 (963 | 0.230 (963) | 0.230 (963) | — | — | 0.230 (963) | 0.230 (963) | 0.230 (963) | — |
| Coefficient of Thermal Expansion | | | | | | | | | | | |
| μin./in. ° F. × $10^{-6}$ (μm/m° K) | 11.6 (21.0) | 11.6 (21.0) | 12.2 (22.0) | 12.1 (21.8) | 11.7 (21.1) | 11.6 (21.0) | 10.0 (18.0) | 11.3 (20.4) | 11.9 (21.6) | 12.2 (22.0) | 13.4 (24.1) |
| Thermal Conductivity | | | | | | | | | | | |
| BTU/ft hr° F. (W/m° K) | 65.3 (113) | 65.3 (113) | 55.6 (96.2) | 55.6 (96.2) | 55.6 (96.2) | 55.6 (96.2) | 77.4 (134) | 70.1 (121) | 70.1 (121) | 82.2 (142) | 55.6 (96.2) |
| Electrical Conductivity | | | | | | | | | | | |
| % IACS | 30 | 29 | 27 | 23 | 23 | 22 | 27 | 31 | 31 | 37 | 24 |
| Poisson's Ratio | 0.33 | 0.33 | 0.33 | 0.33 | 0.33 | — | — | — | — | 0.33 | — |

Table 3 from NADCA reproduced below includes mechanical properties of magnesium alloys, Zamak die casting alloys, and ZA die casting alloys used in high pressure die casting.

TABLE 3

| Die Casting Alloy Properties. | | | | | | | | | | |
|---|---|---|---|---|---|---|---|---|---|---|
| Magnesium Alloys | | | Zamak Die Casting Alloys | | | | ZA Die Casting Alloys | | | |
| AZ91D | AM60B | AS41B | No. 2 | No. 3 | No. 5 | No. 7 | ZA-8 | ZA-12 | ZA-27 | Designation |
| Mechanical Properties | | | | | | | | | | |
| Ultimate Tensile Strength | | | | | | | | | | |
| 34 (230) | 32 (220) | 31 (215) | 52 (359) | 41 (283) | 48 (328) | 41 (283) | 54 (372) | 59 (400) | 62 (426) | ksi (MPa) |
| Tensile Yield Strength (A) | | | | | | | | | | |
| 23 (160) | 19 (130) | 20 (140) | 41 (283) | 32 (221) | 39 (269) | 32 (221) | 41-43 (283-296) | 45-48 (310-331) | 52-55 (359-379) | ksi (MPa) |
| Compressive Yield Strength (B) | | | | | | | | | | |
| 24 (165) | 19 (130) | 20 (140) | 93 (641) | 60(M) (414) | 87(M) (600) | 60(M) (414) | 37 (252) | 39 (269) | 52 (358) | ksi (MPa) |
| Elongation | | | | | | | | | | |
| 3 | 6-8 | 6 | 7 | 10 | 7 | 13 | 6-10 | 4-7 | 2.0-3.5 | % in 2 in. (51 mm) |
| Hardness | | | | | | | | | | |
| 75(C) | 62(C) | 75(C) | 100(C) | 82(C) | 91(C) | 80(C) | 100-103(C) | 95-105(C) | 116-122(C) | BHN |

TABLE 3-continued

| Die Casting Alloy Properties. | | | | | | | | | | |
|---|---|---|---|---|---|---|---|---|---|---|
| Magnesium Alloys | | | Zamak Die Casting Alloys | | | | ZA Die Casting Alloys | | | |
| AZ91D | AM60B | AS41B | No. 2 | No. 3 | No. 5 | No. 7 | ZA-8 | ZA-12 | ZA-27 | Designation |
| Shear Strength | | | | | | | | | | |
| 20<br>(140) | n/a | n/a | 46<br>(317) | 31<br>(214) | 38<br>(262) | 31<br>(214) | 40<br>(275) | 43<br>(296) | 47<br>(325) | ksi<br>(MPa) |
| Impact Strength | | | | | | | | | | |
| 1.6(H)<br>(2.2) | 4.5(H)<br>(6.1) | 3.0(H)<br>(4.1) | 35(H)<br>(47.5) | 43(H)<br>(58) | 48(H)<br>(65) | 43(H)<br>(58) | 24-35(H)<br>(32-48) | 15-27(H)<br>(20-37) | 7-12(H)<br>(9-16) | ft-lb<br>(J) |
| Fatigue Strength | | | | | | | | | | |
| 10(I)<br>(70) | 10(I)<br>(70) | n/a | 8.5(D)<br>(58.6) | 6.9(D)<br>(47.6) | 8.2(D)<br>(56.5) | 6.9(D)<br>(47.6) | 15(D)<br>(103) | — | 21(D)<br>(145) | ksi<br>(MPa) |
| Young's Modulus | | | | | | | | | | |
| 6.5<br>(45) | 6.5<br>(45) | 6.5<br>(45) | (N) | (N) | (N) | (N) | 12.4<br>(85.5) | 12<br>(83) | 11.3<br>(77.9) | psi × $10^6$<br>(GPa) |
| Physical Properties Density | | | | | | | | | | |
| 0.066<br>(1.81) | 0.065<br>(1.79) | 0.064<br>(1.77) | 0.24<br>(6.6) | 0.24<br>(6.6) | 0.24<br>(6.7) | 0.24<br>(6.6) | 0.227<br>(6.3) | 0.218<br>(6.03) | 0.181<br>(5.00) | lb/in$^3$<br>(g/cm$^3$) |
| Melting Range | | | | | | | | | | |
| 875-1105<br>(470-595) | 1005-1140<br>(540-615) | 1050-1150<br>(565-620) | 715-734<br>(379-390) | 718-728<br>(381-387) | 717-727<br>(380-386) | 718-728<br>(381-387) | 707-759<br>(375-404) | 710-810<br>(375-404) | 708-903<br>(375-484) | ° F.<br>(° C.) |
| Specific Heat | | | | | | | | | | |
| 0.25<br>(1050) | 0.25<br>(1050) | 0.24<br>(1050) | 0.10<br>(419) | 0.10<br>(419) | 0.10<br>(419) | 0.10<br>(419) | 0.104<br>(435) | 0.107<br>(450) | 0.125<br>(525) | BTU/lb° F.<br>(J/kg° C.) |
| Coefficient of Thermal Expansion | | | | | | | | | | |
| 13.8<br>(25.0) | 14.2<br>(25.6) | 14.5<br>(26.1) | 15.4<br>(27.8) | 15.2<br>(27.4) | 15.2<br>(27.4) | 15.2<br>(27.4) | 12.9<br>23.2 | 13.4<br>(24.1) | 14.4<br>(26.0) | μin./in. ° F. × $10^{-6}$<br>(μm/m° K) |
| Thermal Conductivity | | | | | | | | | | |
| 41.8(J)<br>(72) | 36<br>(62) | 40<br>(68) | 60.5<br>(104.7) | 65.3<br>(113) | 62.9<br>(109) | 65.3<br>(113) | 66.3<br>(115) | 67.1<br>(116) | 72.5<br>(122.5) | BTU/ft hr° F.<br>(W/m° K) |
| Electrical Conductivity | | | | | | | | | | |
| 10<br>0.35 | 11<br>0.35 | 0.35 | 25.0<br>0.30 | 27.0<br>0.30 | 26.0<br>0.30 | 27.0<br>0.30 | 27.7<br>0.30 | 28.3<br>0.30 | 29.7<br>0.30 | % IACS<br>Poisson's Ratio |

High Pressure Die Casting with Nanoparticles Modified Metal Alloys

In many embodiments, metal alloys modified with nanoparticles can enable die casting of high performance metal alloys. In several embodiments, nanoparticle modified aluminum alloys have low or no silicon content. Some embodiments provide that nanoparticle modified in metal alloys allow high-performance wrought and cast alloys including (but not limited to) aluminum alloys, with a low silicon content for structural applications. In certain embodiments, silicon content of nanoparticle modified metal alloys is from about 0 wt. % to about 4.0 wt. %. As can readily be appreciated, any of a variety of silicon content of less than about 4.0 wt. % can be utilized as appropriate to the requirements of specific applications in accordance with various embodiments of the invention. Many embodiments provide that nanoparticles can simultaneously enhance the fluidity of alloys (die-filling) and eliminate hot cracking under high cooling rate, without the addition of a silicon content higher than about 4.0 wt %.

Several embodiments provide that metal alloys that can be modified with nanoparticles include at least one metal element including (but not limited to) aluminum (Al), magnesium (Mg), iron (Fe), silver (Ag), copper (Cu), manganese (Mn), nickel (Ni), titanium (Ti), chromium (Cr), cobalt (Co), zinc (Zn), and alloys, mixtures, or other combinations of two or more of the foregoing metals, Al alloys, Mg alloys, Zn alloys, Ti—Al alloys, Al—Mg alloys, and Mg—Zn alloys, and alloys, mixtures, or other combinations of one or more of the foregoing metals with other elements, such as steel (e.g., iron-carbon alloys or iron-chromium-carbon alloys). As can readily be appreciated, any of a variety of metal alloy can be utilized as appropriate to the requirements of specific applications in accordance with various embodiments of the invention. Many embodiments make alloy systems that are traditionally hard to die cast, suitable for die casting after modification with nanoparticles. In several embodiments, aluminum alloys, magnesium alloys, and zinc alloys can be modified with nanoparticles to adapt to high pressure die casting. A number of embodiments provide that nanoparticle modified alloy systems for die casting also have desired mechanical performance, thermal conductivity, and electrical conductivity. Examples of alloy systems include (but are not limited to) A201, AA2024, A206, AA2618, AA5083, AA6013, AA6061, AA6063, AA6069, AA7034, AA7050, AA7075, and AA7068. As can readily be appreciated, any of a variety of alloy system can be utilized as appropriate to the requirements of specific applications in accordance with various embodiments of the invention.

Many embodiments provide that nanoparticles are uniformly dispersed in the metal alloy matrix. A number of embodiments provide that materials from which the nanoparticles can be made include (but are not limited to) ceramics, oxides, nitrides, borides, carbides and other carbon-based particles, metals and metal alloys, and core-shell particles. Specific examples of the types of nanoparticles that may be dispersed in the metal matrices include aluminum oxide nanoparticles, aluminum nitride nanoparticles, carbon nanotubes, silicon carbide nanoparticles, silicon nitride nanoparticles, titanium carbide nanoparticles, titanium boride nanoparticles, titanium carbonitride nanoparticles, tungsten carbide nanoparticles, and core-shell particles. In addition, the nanoparticles can be core-shell type nanoparticles that include a core material and a coating. Examples include SiC nanoparticles coated with SiO, and ceramic nanoparticles coated with a metal Such as nickel or silver. (See, e.g., U.S. Pat. No. 9,023,128 B2 to Li et al., the disclosure of which is incorporated herein by reference in its entirety.)

In some embodiments, the nanoparticles can include one or more ceramics, although other nanoparticle materials are contemplated, including metals or other conductive materials. Examples of suitable nanoparticle materials include metal oxides (e.g., alkaline earth metal oxides, post-transition metal oxides, and transition metal oxides, such as aluminum oxide ($Al_2O_3$), magnesium oxide (MgO), titanium oxide ($TiO_2$), yttrium oxide ($Y_2O_3$), magnesium aluminate ($MgAl_2O_4$), and zirconium oxide ($ZrO_2$)), non-metal oxides (e.g., silicon oxide ($SiO_2$)), metal carbides (e.g., transition metal carbides, such as titanium carbide (TiC), niobium carbide (NbC), chromium carbide ($Cr_3C_2$), nickel carbide (NiC), hafnium carbide (HfC), vanadium carbide (VC), tungsten carbide (WC), and zirconium carbide (ZrC)), non-metal carbides (e.g., silicon carbide (SiC)), metal silicides (e.g., transition metal silicides, such as titanium silicide ($Ti_5Si_3$)), metal borides (e.g., transition metal borides, such as titanium boride ($TiB_2$), zirconium boride ($ZrB_2$), hafnium boride ($HfB_2$), vanadium boride ($VB_2$), and tungsten boride ($W_2B_5$)), metal nitrides (e.g., transition metal nitrides), core-shell particles, metals (e.g., transition metals in elemental form such as tungsten (W)), alloys, mixtures, or other combinations of two or more of the foregoing, and alloys, mixtures, or other combinations of one or more of the foregoing with other elements. Particular examples of suitable nanoparticle materials include transition metal-containing ceramics, where the presence of a transition metal can impart a greater Hamaker constant more closely approaching that of a metal matrix for a reduced van der Waals potential well, such as transition metal carbides, transition metal silicides, transition metal borides, transition metal nitrides, and other non-oxide, transition metal-containing ceramics. (See, e.g., U.S. Pat. No. 11,040,395 B2 to Li et al., the disclosure of which is incorporated herein by reference in its entirety.)

In many embodiments, the nanoparticles may have an average diameter of less than about 500 nm. In some embodiments, the nanoparticles may have an average diameter of between about 1 nm and about 500 nm; between about 1 nm and about 400 nm; between about 1 nm and about 300 nm; between about 1 nm and about 200 nm; between about 1 nm and about 100 nm; between about 1 nm and about 70 nm; between about 1 nm and about 50 nm; between about 1 nm and about 30 nm. Several embodiments provide that the distribution of sizes of the nanoparticles can be characterized by a standard deviation, relative to an average diameter, that is up to about 100%, up to about 90%, up to about 80%, up to about 70%, up to about 60%, or up to about 50% of the average diameter. In certain embodiments, the nanoparticles can have generally spherical or spheroidal shapes, although other shapes and configurations of nanoparticles are contemplated.

Many embodiments provide that the metal alloy can include nanoparticles at a volume percentage in a range of about 0.1% to 2%, about 0.25% to 2%, about 0.5% or greater, about 1% or greater, about 2% or greater, about 3% or greater, about 5% or greater, about 6% or greater, about 7% or greater, about 8% or greater, about 9% or greater, about 10% or greater, about 15% or greater, about 20% or greater, or about 25% or greater, and up to about 30% or greater. As can readily be appreciated, any of a variety of nanoparticle concentration can be utilized as appropriate to the requirements of specific applications in accordance with various embodiments of the invention.

Several embodiments provide that die cast metal alloys including (but not limited to) aluminum alloys with less than 4% silicon content exhibit desirable mechanical properties, thermal conductivity, and electrical conductivity. The mechanical properties, thermal conductivity, and electrical conductivity are measured for as-cast metal alloys without post processing. Some embodiments provide a low volume percentage of nanoparticles (from about 0.1% to about 2%) can be successfully applied to die cast the traditionally difficult or impossible to cast aluminum alloys. Examples of such alloys include (but are not limited to) AA6061 (Al-1.0Mg-0.6Si-0.25Cu), AA6063 (Al-0.7Mg-0.4Si), A206 (Al-4.5Cu-0.3Mg), AA7075 (Al-5.6Zn-2.6Mg-1.6Cu), and a modified AA7075 ((Al-5.6Zn-2.6Mg-0.65Cu) for natural aging. These die casting alloys in accordance with several embodiments show good die casting capability while achieve high strength and good ductility. The strength and ductility are measured for as-cast alloys, without post processing. In many embodiments, die cast AA6061 and other 6000s aluminum alloys can offer ductility and/or elongation less than or equal to about 30%; or from about 20% to about 30%; or less than or equal to about 20%; or from about 10% to about 20%; or less than or equal to about 10%; and thermal conductivity of less than or equal to about 230 W/mw; or from about 200 W/mw to about 230 W/mw; or from about 100 W/mw to about 200 W/mw; or less than or equal to about 100 W/mw, better than other commercially available die cast Al—Si alloys (see Table 2 above).

Many embodiments provide high pressure die casting of 7000 series aluminum alloys. The die cast 7000 series aluminum alloys can open up application space for die casting high strength aluminum alloys. Modified AA7075 alloy may be capable of offering extreme high strength by natural aging after die casting in accordance with embodiments.

The increased fluidity and hot cracking resistance of the nanoparticle modified metal alloys in accordance with some embodiments enable the production of thin wall structures using high pressure die casting processes, due to the low silicon content of die cast metal alloys. Many embodiments produce die cast metal part with a thickness between about 0.2 mm to about 0.5 mm; or greater than or equal to about 0.5 mm.

Some embodiments provide that thermal conductivity of die cast metal alloys can be affected by the porosity. Normally high pressure die casting of aluminum parts have porosity from about 3% to about 5%. Certain embodiments provide that the porosity of die cast nanoparticle infused metal alloys may vary in different parts. The porosity of die cast parts can be improved in vacuum die casting or process optimization.

Many embodiments provide good anodizing capability and quality of die cast metal alloys with nanoparticles. Traditionally, die cast aluminum alloys have high Si content. Anodizing high Si content alloys may make Si stand out and turn the metal parts to gray or black. Thus, high Si content alloys may not be able to produce different colors via anodizing. In several embodiments, metal alloys with nanoparticles have Si content of less than 4 wt. % and can be anodized to produce various color parts. Color can be determined by dyes used to color the surface porous oxide after chemical treatment. Some embodiments provide that any color can be applied to the die cast metal alloys. Metal alloys with nanoparticles can also be successfully anodized to various colors due to low or no silicon effect.

Several embodiments provide that post processing can be applied to die cast metal alloys with nanoparticles, but not necessary. Normally high pressure die cast alloys do not want any solution treatment due to blistering effect. In some embodiments, post processing including (but not limited to) T5 or natural aging can be applied. In certain embodiments, post processing including (but not limited to) T6 can be applied to die cast metal parts with low or no porosity (such as after vacuum high pressure die casting). As can readily be appreciated, any of a variety of post processing treatment can be utilized as appropriate to the requirements of specific applications in accordance with various embodiments of the invention.

Many embodiments provide high pressure die casting processes with metal alloys infused with nanoparticles. In several embodiments, the metal alloys including (but not limited to) aluminum alloys, magnesium alloys, and zinc alloys, have silicon content of less than about 4 wt. %. A high pressure die casting process in accordance with an embodiment of the invention is illustrated in FIG. 1. The process 100 begins by preparing metals and/or metal alloys with nanoparticles 101. In some embodiments, nanoparticles can be incorporated and dispersed uniformly in metal matrix. In several embodiments, nanoparticles can have about 0.1 vol. % to about 2 vol. % in the metal alloys. Certain embodiments provide nanoparticles can be made of materials including (but not limited to) metal oxides (e.g., alkaline earth metal oxides, post-transition metal oxides, and transition metal oxides, such as aluminum oxide ($Al_2O_3$), magnesium oxide (MgO), titanium oxide ($TiO_2$), yttrium oxide ($Y_2O_3$), magnesium aluminate ($MgAl_2O_4$), and zirconium oxide ($ZrO_2$)), non-metal oxides (e.g., silicon oxide ($SiO_2$)), metal carbides (e.g., transition metal carbides, such as titanium carbide (TiC), niobium carbide (NbC), chromium carbide ($Cr_3C_2$), nickel carbide (NiC), hafnium carbide (HfC), vanadium carbide (VC), tungsten carbide (WC), and zirconium carbide (ZrC)), non-metal carbides (e.g., silicon carbide (SiC)), metal silicides (e.g., transition metal silicides, such as titanium silicide ($Ti_5Si_3$)), metal borides (e.g., transition metal borides, such as titanium boride ($TiB_2$), zirconium boride ($ZrB_2$), hafnium boride ($HfB_2$), vanadium boride ($VB_2$), and tungsten boride ($W_2B_5$)), metal nitrides (e.g., transition metal nitrides), core-shell particles, metals (e.g., transition metals in elemental form such as tungsten (W)). Previous work has described in details the preparations of nanoparticles mixed with metal alloys (See, e.g., PCT Application No. PCT/US20/27775 to Li et al.; U.S. Pat. No. 9,322,084 B2 to Li et al.; U.S. Pat. No. 9,023,128 $B_2$ to Li et al.; the disclosures of which are incorporated herein by references by their entirety.)

The metals mixed with nanoparticles can be melted and further alloyed to form molten metal alloys with certain compositions 102. Aluminum alloys including (but not limited to) AA6061, AA6063, AA6069, AA2024, AA5083, AA7075, A206, A201, AA6013, AA2024, AA7034, AA7050, and AA7068, can be prepared for high pressure die casting. Many embodiments provide that metal alloys mixed with nanoparticles have less than about 4 wt. % silicon in order to improve mechanical properties, thermal conductivities, and anodizing capabilities of such alloys.

Die cavity can be prepared before injecting the molten metal alloys 103. The inside of the die mold can be sprayed with a layer of lubricant to ease the release of cast metal parts. Molten metal alloys can be injected into the die mold under a high pressure 104. Many embodiments provide that the pressure to inject molten metal alloy ranges from about 30 MPa to about 100 MPa. In certain embodiments, the pressure can be lower than about 30 MPa, or higher than about 100 MPa. In some embodiments, the pressure can be higher than 100 MPa. The pressure is maintained until the casting solidifies. The die is then cooled with a high cooling rate 105. In several embodiments, the cooling rate can range from about 100° C./s to about 300° C./s to solidify the molten metal alloy. In a number of embodiments, the cooling rate can be lower than about 100° C./s, or higher than about 300° C./s. Nanoparticles can improve the fluidity and hot cracking resistance and reduce die sticking of metal alloys with low silicon content, thus render alloys with less than 4 wt. % silicon compatible with the high pressure injection process and the rapid cooling process. Once the metal alloy solidifies, the metal parts can be retrieved (not shown).

The die cast metal parts can be anodized to add desired colors 106. Anodizing can be optional. High silicon content in metal alloy may appear gray or black after anodizing. In comparison, the nanoparticles modified metal alloys have silicon of less than 4 wt. % compared to the normal 8 wt. %-10 wt. % silicon. The low silicon metal alloy in accordance with many embodiments do not appear gray or black after anodizing. Thus, the die cast metal parts with nanoparticle modified metal alloys can be anodized to add any color of choice including (but not limited to) red, blue, green, yellow, silver, gold.

Figure 2B:
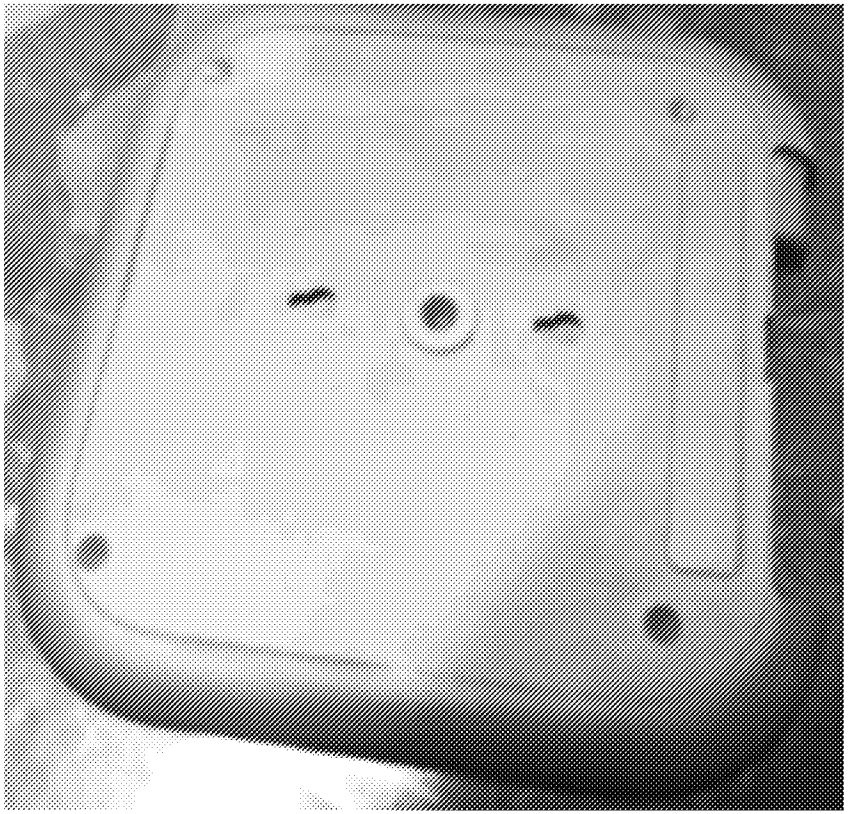
FIG. 2B illustrates a high pressure die cast AA6061 part with 1.0 vol. % TiC nanoparticles in accordance with an embodiment of the invention.
Figure 2A:
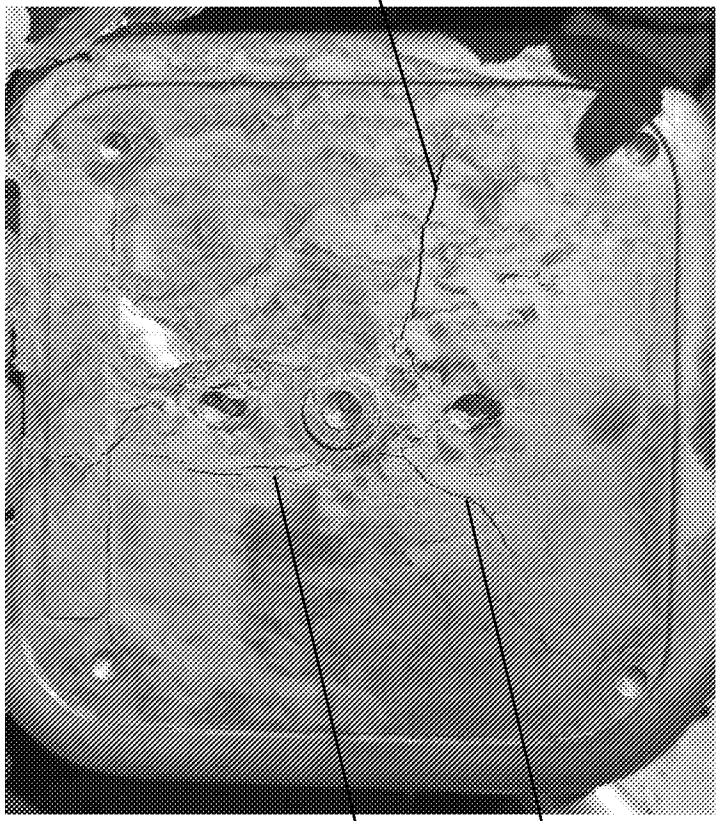
FIG. 2A illustrates a high pressure die cast AA6061 part without nanoparticles in accordance with an embodiment of the invention.

Die cast aluminum alloy samples in accordance with an embodiment of the invention are illustrated in FIG. 2A and FIG. 2B. FIG. 2A illustrates a die cast AA6061 alloy sample. The AA6061 alloy used in FIG. 2A is not modified with nanoparticles. The die cast sample shows multiple crack lines 201. FIG. 2B illustrates a die cast AA6061 alloy modified with about 1.0 vol. % TiC nanoparticles. The die cast sample has smooth surface. The sample is anodized to obtain red color.

EXEMPLARY EMBODIMENTS

Although specific embodiments of systems and methods are discussed in the following sections, it will be understood that these embodiments are provided as exemplary and are not intended to be limiting.

Example 1: High Pressure Die Casting AA6061 Alloy

Many embodiments provide high pressure die casting of aluminum alloys including (but not limited to) high performance AA6061 alloy. In several embodiments, AA6061 alloy can be modified with about 1.0 vol % nanoparticles including (but not limited to TiC nanoparticles. Table 4 below lists properties of die cast AA6061 alloy containing about 1.0 vol. % nanoparticles. The nanoparticle modified AA6061 alloy has as-cast ultimate tensile strength of about 205 MPa, yield strength of about 125 MPa, elongation of about 16%, and thermal conductivity of about 140 W/mk). Post processing can further improve the mechanical properties. After T5 treatment, the AA6061 alloy has ultimate tensile strength of about 226 MPa, yield strength of about 165 MPa, elongation of about 10%, and thermal conductivity of about 142 W/mk). After T6 treatment, the AA6061 alloy has ultimate tensile strength of about 353 MPa, yield strength of about 305 MPa, elongation of about 9%, and thermal conductivity of about 145 W/mk).

TABLE 4

Typical Properties of Die Cast AA6061 containing 1.0 vol % nanoparticles

| Heat Treatment | Ultimate Tensile Strength (MPa) | Yield Strength (MPa) | Elongation (%) | Thermal Conductivity (W/mk) |
|---|---|---|---|---|
| As Die cast | 205 | 125 | 16 | 140 |
| T5 | 226 | 165 | 10 | 142 |
| T6* (if air trapping is not an issue) | 353 | 305 | 9 | 145 |

Figure 3B:
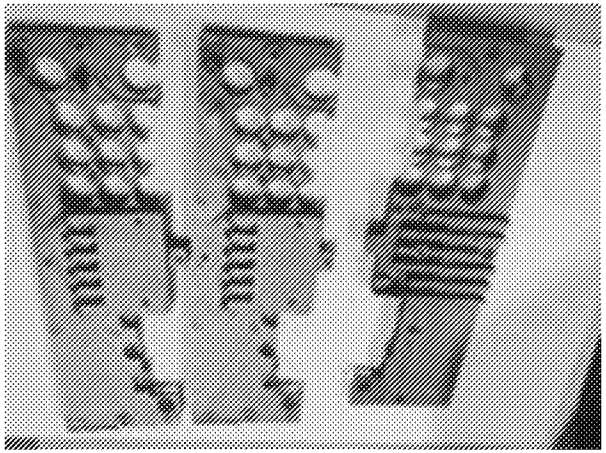
FIGS. 3A-3D illustrate colored die cast AA6061 parts with 1.0 vol. % nanoparticles after anodizing.
Figure 3D:
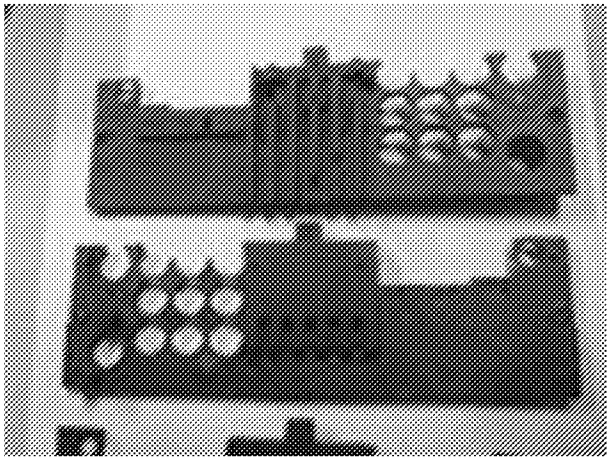
Figure 3A:
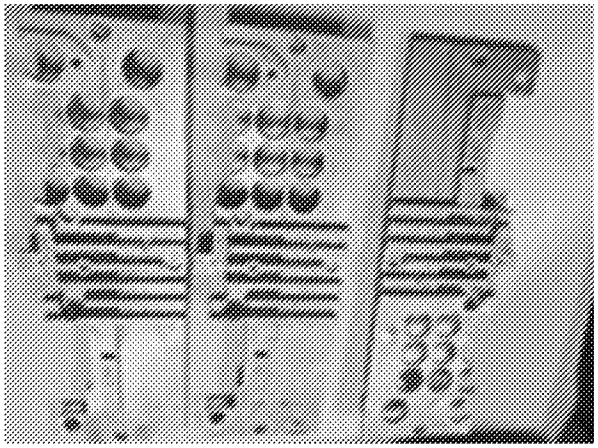
Figure 3C:
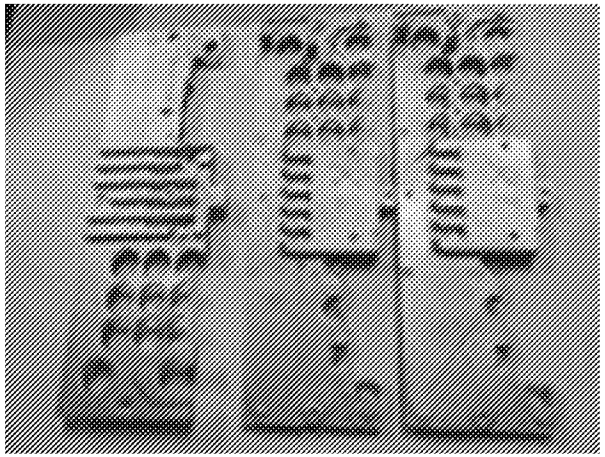

Die cast aluminum alloys including (but not limited to) AA6061 alloy can be anodized to add any color of choice. Die cast parts of AA6061 showing various colors in accordance with an embodiment of the invention are illustrated in FIGS. 3A-3D. In FIGS. 3A-3D, the die cast AA6061 parts containing about 1.0 vol % TiC nanoparticles. FIG. 3A shows the die cast part can be anodized to have gold color. FIG. 3B shows the die cast aluminum part can be anodized to have red color. FIG. 3C shows the die cast part can be anodized to have silver color. FIG. 3D shows the die cast alloy can be anodized to be blue in color. The die cast metal parts show smooth surface without cracks.

Example 2: High Pressure Die Casting A206 Alloy

Several embodiments provide high pressure die casting of aluminum alloys including (but not limited to) high performance A206 alloy. For A206 alloy, nanoparticles allow much better fluidity and eliminate hot cracking to enable reliable die casting of this traditional-difficult die casting alloys in accordance with many embodiments. The addition of nanoparticles also improves die filling, part pressure tightness, strength and ductility. The die cast A206 alloy with nanoparticles can offer strength of up to about 450 MPa, elongation of up to 15%.

DOCTRINE OF EQUIVALENTS

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

As used herein, the singular terms "a," "an," and "the" may include plural referents unless the context clearly dictates otherwise. Reference to an object in the singular is not intended to mean "one and only one" unless explicitly so stated, but rather "one or more."

As used herein, the terms "approximately" and "about" are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

What is claimed is:

1. A method for die casting comprising:

melting a metal alloy, wherein the metal alloy is modified with at least one type of nanoparticle, wherein the metal alloy comprises a silicon weight concentration of less than 4.0%;

filling a die with the molten metal alloy under a pressure greater than 100 MPa; and cooling the die to solidify the molten metal alloy with a cooling rate between 100° C./s and 300° C./s.

2. The method of claim 1, further comprising anodizing the die cast metal alloy with at least one color.

3. The method of claim 1, wherein the metal alloy is selected from the group consisting of an aluminum alloy, a magnesium alloy, a copper alloy, and a zinc alloy.

4. The method of claim 1, wherein the metal alloy is selected from the group consisting of A201, AA2024, A206, AA2618, AA5083, AA6013, AA6061, AA6063, AA6069, AA7034, AA7050, AA7075, and AA7068.

5. The method of claim 1, wherein the at least one type of nanoparticle is selected from the group consisting of a metal oxide, a non-metal oxide, a metal carbide, a non-metal carbide, a metal silicide, a metal boride, a metal nitride, and any combinations thereof.

6. The method of claim 1, wherein the at least one type of nanoparticle has a structure of a core-shell particle.

7. The method of claim 1, wherein the at least one type of nanoparticle comprises less than 30 vol. % of the metal alloy.

8. The method of claim 1, wherein the nanoparticle comprises 0.1 vol. % to 2 vol. % of the metal alloy.

9. The method of claim 1, wherein the metal alloy comprises AA6061 and the nanoparticle comprises TiC or $TiB_2$, and the TIC or $TiB_2$ nanoparticle comprises 1.0 vol. % of the metal alloy.

10. The method of claim 1, wherein the die cast metal alloy as formed has an elongation equal to or less than 30% and an ultimate tensile strength greater than 500 MPa.

11. The method of claim 1, wherein the die cast metal alloy has a thickness of at least 0.2 mm.

12. The method of claim 1, further comprising a post process selected from the group consisting of: a T5 treatment, a natural aging treatment, and a T6 treatment.

* * * * *